US005127859A

United States Patent [19]

Rantilla

[11] Patent Number: 5,127,859

[45] Date of Patent: Jul. 7, 1992

[54] FRONT FACING ROWING APPARATUS

[76] Inventor: Ronald R. Rantilla, 7 Pond Ave., Foxboro, Mass. 02035

[21] Appl. No.: 676,194

[22] Filed: Mar. 27, 1991

[51] Int. Cl.[5] ..... B63H 16/06

[52] U.S. Cl. ..... 440/104

[58] Field of Search ..... 440/101-107; 416/74, 75

[56] References Cited

U.S. PATENT DOCUMENTS

| | | | |
|---|---|---|---|
| 15,794 | 9/1856 | Rode . | |
| 116,094 | 6/1871 | Pringle . | |
| 287,088 | 10/1883 | Beckers . | |
| 387,743 | 8/1888 | Smith . | |
| 557,318 | 3/1896 | Tenney | 440/102 |
| 826,693 | 7/1906 | Sheen . | |
| 1,034,462 | 8/1912 | Johnson . | |
| 1,289,038 | 12/1918 | Talbot . | |
| 2,083,004 | 6/1937 | Clark . | |
| 2,245,401 | 6/1941 | Hooker . | |
| 3,729,369 | 4/1973 | Trull . | |
| 3,884,175 | 5/1975 | Bellis . | |
| 3,951,095 | 4/1976 | Jewett . | |
| 4,052,951 | 10/1977 | Farr . | |
| 4,383,830 | 5/1983 | Cartwright | 440/104 |
| 4,623,314 | 11/1986 | Waugh | 440/104 |
| 4,738,643 | 4/1988 | Noggle | 440/103 |
| 4,776,682 | 10/1988 | du Pont | 440/101 |

FOREIGN PATENT DOCUMENTS

| | | | |
|---|---|---|---|
| 749730 | 7/1980 | U.S.S.R. | 440/101 |

*Primary Examiner*—Jesûs D. Sotelo

[57] ABSTRACT

Apparatus for propelling a boat in the direction in which the oarsman is facing using oars which are connected to a support (80) at their innermost ends (18) so that they are movable rotatably in a horizontal plane, rotatably in a vertical plane and linearly up and down, and which are suspended above the water by a downward force from a compression spring (66) applied at a point inboard of a fulcrum (74) which is attached to the oar connection joint clevis (46) and which is supported by a horizontal bearing surface (72) on which the fulcrum (74) slides as the oar is moved.

6 Claims, 4 Drawing Sheets

FRONT FACING ROWING APPARATUS

FIELD OF INVENTION

This invention relates to boat rowing apparatus, and specifically to forward facing rowing apparatus having the oars attached at their innermost ends and having a means of suspending the oars so that they are above the water level when hands free.

DISCUSSION OF PRIOR ART

Conventional rowing mechanisms have the oar attachment points located outboard as far as possible, usually on the gunwales or on outriggers, and the handle portions located somewhere inboard of that point. The rower sits facing the stern of the boat and, using a pulling motion on the power stroke, propels the boat in the direction opposite that which he is facing. Some high performance rowing systems (called sculls) include a sliding seat, allowing the use of legs to assist in pulling. The oars are feathered (the blades are turned horizontal) on the return stroke to reduce wind resistance.

The main drawback of such systems is that the rower has difficulty in seeing where he is going and must twist around to see what is in front of the boat. This creates the danger of a collision, especially if there are other rearward facing rowers in the same area. These systems are not suited to such activities as viewing or photographing wildlife or rowing on winding rivers or rivers with navigational hazards. Other drawbacks are that the outriggers add width to the boat and the oars are long (9.5 feet) requiring a wide channel for operation of the boat and adding wind resistance. Another drawback is that the oars cannot easily be lifted to clear obstacles, making it difficult to maneuver in tight quarters.

Several types of front facing rowing systems have been proposed, for example:

U.S. Pat. No. 4,738,643 to Noggle (1988) discloses a two piece oar and a transmission mechanism to reverse the direction of the blade portion relative to the handle portion. This system has the transmission mechanism attached to the boat on the gunwales or on outriggers. This system has the problems of extra boat width, long oars and limited oar movement. U.S. Pat. Nos. 15,794 to Rode (1856), 116,095 to Pringle (1871), 3,729,369 to Trull (1973), 1,034,462 to Johnson (1912) and 3,884,175 to Bellis (1975) are similar, having reversing transmission means attached outboard of the handle. U.S. Pat. No. 557,318 to Tenney (1896) discloses two piece oar with reversing transmission and oar with automatic feathering mechanism.

U.S. Pat. No. 4,052,951 to Farr (1977) discloses a forward facing rowing system in which the oars are attached to articulate side rails. The problem here is that the rails themselves must be spaced a substantial distance from the centerline of the boat, adding to the width of the hull, and the movement of the oars is severely restricted, making it difficult to maneuver in tight quarters.

U.S. Pat. No. 3,951,095 to Jewett (1976) discloses a front facing rowing system having crisscrossed oars. The problem here is that the sweeping motion of the oars is restricted and the full weight of the oars must be lifted, which would become tiresome. Also, the oars cannot be feathered.

U.S. Pat. No. 826,693 to Sheen (1906) discloses a front facing rowing system using a collapsing blade arrangement. This is a push-pull system and does not have the mechanical advantage of lever type oars.

U.S. Pat. No. 2,083,004 to Clark (1934) discloses a system in which the oars are attached at their inboard ends. The problem with this system is that the full weight of the oars must be lifted on the return stroke which would become tiresome and there is no means of positively positioning the oar in the feathered and power stroke positions.

U.S. Pat. No. 287,088 to Beckers (1883) discloses a system in which the oars are attached at the inboard ends and using torsion springs to support the oars. The problems with this system are: (a) the pivot angle is not perpendicular making it difficult to maintain a constant depth while sweeping the oars through the water on the power stroke because the amount of downward pressure must be constantly varied, (b) the oars will always swing away from the centerline of the boat if not held in position which would be troublesome while docking, (c) the oars cannot be lifted to the vertical position to clear obstacles, (d) the springs themselves are the connection means, making for a springy, wobbly connection. CCCP Patent 749730 to Rumyantsev (1980) discloses an oar with two handles, one of which is bent, which is for use with two hands. The centerline of the bent handle is on the centerline between the blade center of pressure and the upper handle and is in a plane perpendicular to the blade. This oar could not be operated with one hand as there is no means of connecting it to a support. The bend of the handle is toward the operator, rather than away from the operator. This handle orientation, if used in a front rowing system, would make wrist movement awkward when feathering and would not create torsion toward the feathered position when hands free.

OBJECTS AND ADVANTAGES

Several objects and advantages of my invention are:

(a) to provide a rowing system in which the rower faces the direction of travel, allowing him to see navigational hazards and to see wildlife before it is frightened away.

(b) to provide a rowing system in which the oars provide stability even with hands free;

(c) to provide a rowing system in which the operation is easily learned, with direct and instinctive motions;

(d) to provide a rowing system which can be used on narrow hulls without the need for outriggers;

(e) to provide a rowing system in which the oars have the equivalent mechanical advantage of conventional (class 1 lever) oars without the extra length of the portion inboard of the fulcrum, thereby reducing weight, momentum and wind resistance;

(f) to provide a rowing system in which the oars can be lifted as high as necessary to clear any obstacle without being removed;

(g) to provide a rowing system in which the return stroke height above the water is maintained uniform throughout the stroke and the height can be easily adjusted;

(h) to provide a rowing system in which the blades can be easily and positively feathered and the pitch angle can be easily and positively adjusted;

(i) to provide a rowing system in which the oars do not require substantial lifting effort;

Further objects and advantages will become apparent from a consideration of the ensuing description and drawings.

LIST OF REFERENCE NUMERALS IN DRAWINGS

Figure 1:
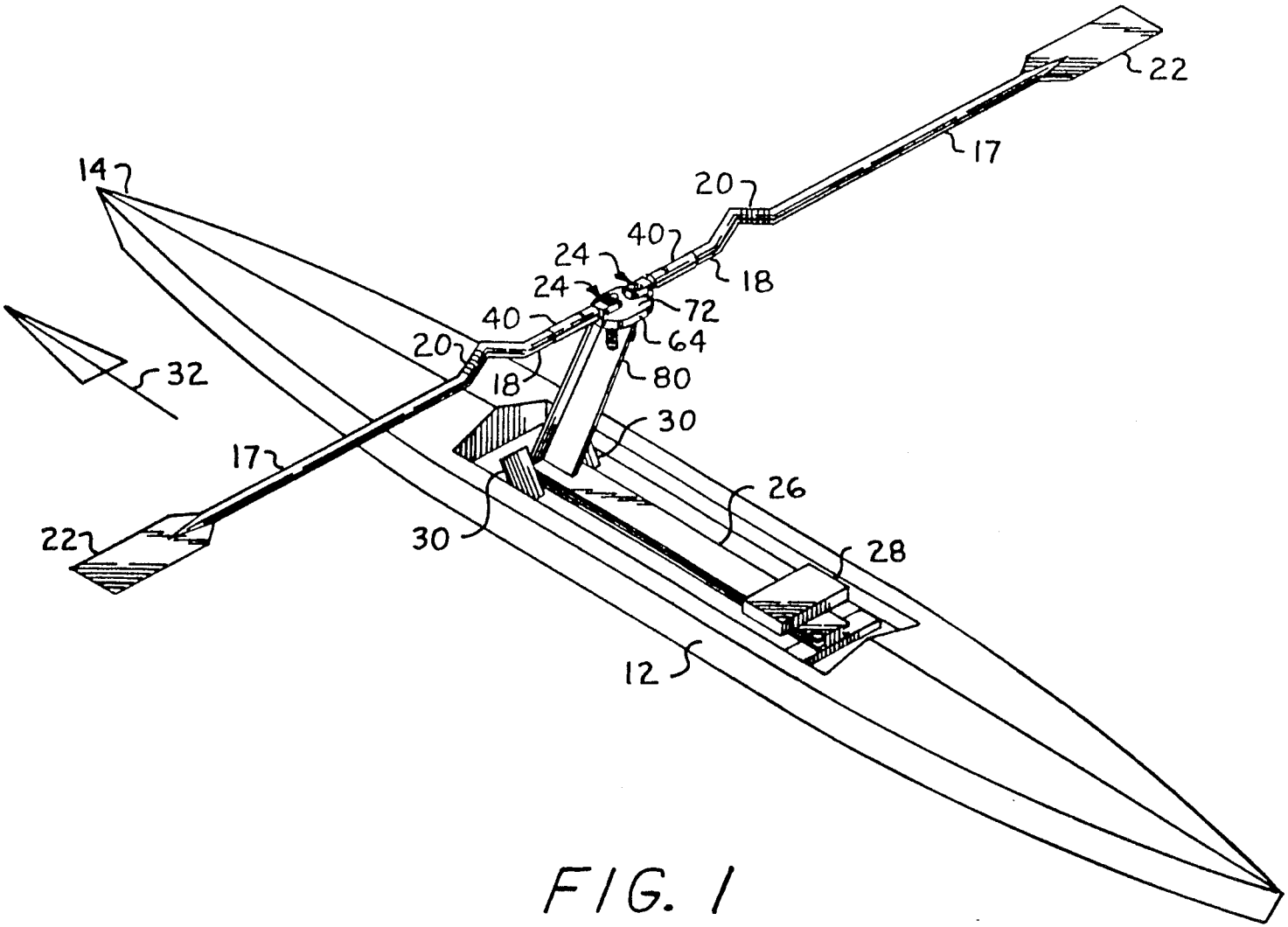
FIG. 1 is an isometric view showing the rowing system installed on a hull with the oars fully lifted and feathered as they would be on the return stroke. This is also the "safe" position in which the oars provide the maximum stability.

12 boat hull
14 bow 15 angle of handle to blade
16 oar retaining pin hole
17 oar outboard shaft portion
18 oar inboard shaft portion
19 oar retaining pin
20 oar handle portion
21 angle of handle bend
22 oar blade portion
24 oar connecting joint
26 base with slide rails
28 sliding seat
30 footrests
32 direction of travel
40 feathering sleeve
**42*a*** bearing
**42*b*** bearing
44 axle shaft
46 clevis
48 nut
50 clamp collar
52 set screw
54 slot
56 pin
58 block
60 vertical shaft
62 guide
64 flange
66 spring
**68*a*** bushing
**68*b*** bushing
70 nut
72 bearing surface
74 sliding fulcrum
76 pin
78 shim
80 column

DESCRIPTION OF INVENTION - FIG. 1, 2, 3, 4

FIG. 1 shows a version of my rowing apparatus. The apparatus is shown installed in a boat 12. The oars have an inboard shaft portion 18, a handle portion 20 which is offset about 30 degrees, an outboard shaft portion 17 and a blade portion 22. The oar upper shaft portion 18 is fitted into a feathering sleeve 40 which is rotatably connected to joint 24. Base 26 is fastened to the boat 12 and supports a sliding seat 28, footrests 30, and a column 80. The column has a flange 64 on top with a bearing surface 72 on its upper surface. Joints 24 are movably connected to the flange 64.

Figure 2:
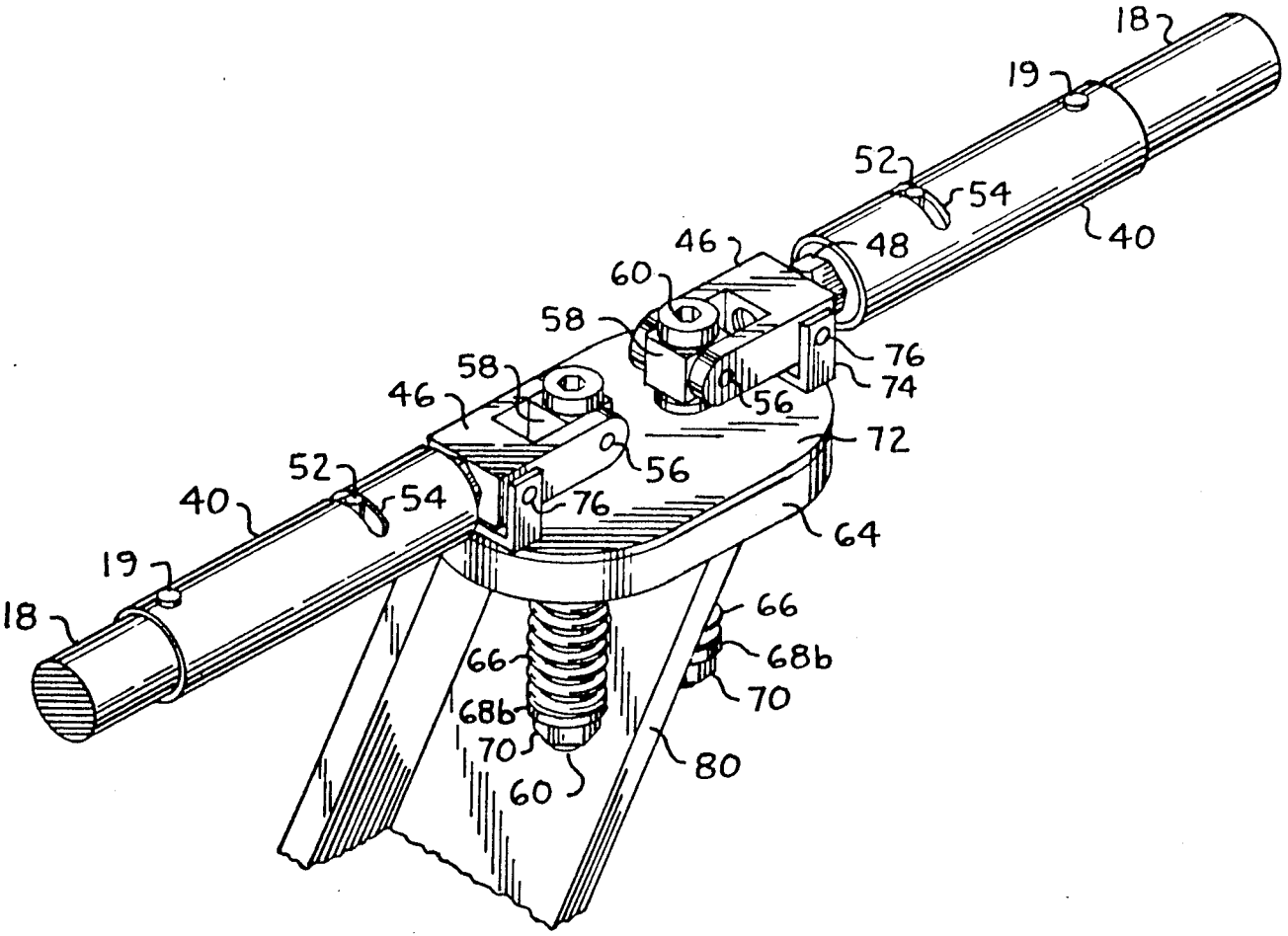
FIG. 2 is an isometric view showing a close up of the oar supporting and feathering mechanisms.

FIG. 2 shows a close up view of the oar connection area. Oar shaft 18 is slip fitted into feathering sleeve 40 and held in place with pin 19. The feathering sleeve 40 is rotatably connected to clevis 46 and locked in place with nut 48. Screw 52 projects through slot 54 and limits rotation of sleeve 40. Clevis 46 is rotatably connected to block 58 by pin 56. Block 58 is connected to vertical shaft 60 which passes through bearing surface 72 and flange 64 and can move rotatably and up and down. Flange 64 is connected to column 80. Compression spring 66 fits over vertical shaft 60 and pushes against flange 64 and bushing **68*a* and 68*b*. Bushing 68*a* slips over vertical shaft 60 and is adjustably held in place by nut 70. On top of flange 64 is a bearing surface 72 which could be a low friction plastic such as nylon held in place with glue or screws. A channel shaped fulcrum 74 is rotatably connected to clevis 46 by pin 76. Fulcrum 74 has a flat bottom which pushes against and slides on the bearing surface 72. Shim 78 slips over vertical shaft 60 and restricts the downward movement of clevis 46**.

Figure 3:
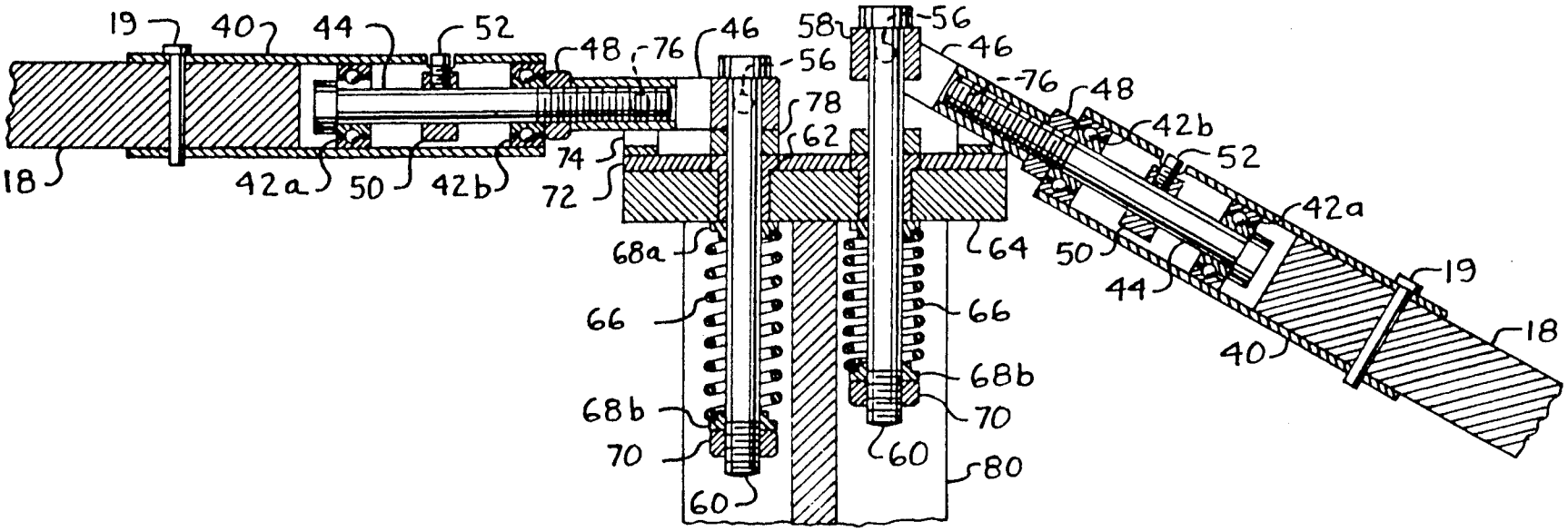
FIG. 3 is a sectional view of the oar supporting and feathering mechanisms showing one oar in the lifted position and one oar in the down position.

FIG. 3 shows a sectional view of the oar connection area as seen from the rear. Oar shaft 18 is slip fitted into feathering sleeve 40 and held in place with pin 19. The feathering sleeve 40 has two bearings **42*a* and 42*b* fitted into it. Axle shaft 44 passes through the bearings and is threaded into clevis 46 and locked in place with nut 48. Axle shaft 44 also passes through clamp collar 50 which is held in place with set screw 52. Set screw 52 projects through slot 54. Clevis 46 is rotatably connected to block 58 by pin 56. Vertical shaft 60 passes through block 58 and guide 62 and can move rotatably and up and down in the guide. Guide 62 is press fitted into flange 64 which is connected to column 80. Compression spring 66 fits over vertical shaft 60 and pushes against bushing 68*a* and 68*b*. The spring tension is adjusted by nut 70. On top of flange 64 is a bearing surface 72. A channel shaped fulcrum 74 is rotatably connected to clevis 46 by pin 54. The fulcrum 74 has a flat bottom which pushes against and slides on the bearing surface 72. Shim 78 slips over vertical shaft 60 and limits the downward travel of block 58**.

Figure 4:
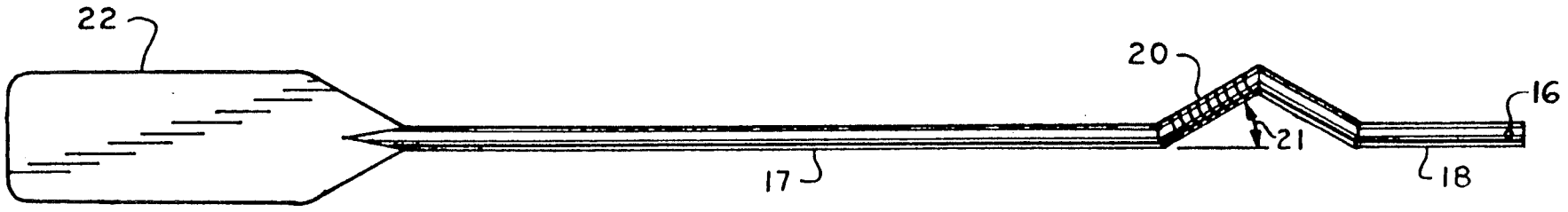
FIG. 4 is a view of the oar showing the unique shape of the handle.

FIG. 4 shows the shape of the oar. When in use, retaining pin hole receives a pin connecting the inboard shaft portion 18 to a support (not shown). The outboard shaft portion 17 and inboard shaft portion 18 are on the same centerline. The handle portion 20 is at an angle 21 of about 30 degrees to this centerline. Blade portion 22 is at the outboard most end.

OPERATION OF INVENTION - FIGS. 1, 2, 3

The embodiment shown in FIG. 1 is a unit which may be mounted in or on a boat or boat hull such as a racing shell or a canoe and which is removable.

The operator sits on seat 28 placing his feet on footrests 30 and grasps the oars by handles 20. The oars, which are suspended in the up position by the oar connecting joint and lift mechanism 24, are swung forward then rotated so that blades 22 are vertical and the handle portions 20 are pointed upward. The oars are then pushed down so the blades are in the water.

For the power stroke, the oars are pulled back toward the operator, propelling the boat forward in direction 32.

At the end of the power stroke, the oars are lifted and rotated so blades are horizontal. The oars are then pushed forward and the power stroke is repeated.

The oar handles 20 are on an angle of about 30 degrees from the main centerline of the oars. This makes a more comfortable wrist position, especially when the oars are extended fully forward. This bend also makes feathering almost automatic because when pushing the oar forward, the grip, being off-center, will have a tendency to roll forward into the feathered position, and when pulling the grip will have a tendency to roll backward into the blade vertical position.

The feathering mechanism is best shown in FIG. 2 and FIG. 3. Sleeve 40 rotates about axle shaft 44 on bearings 42*a* and 42*b*. The rotation is limited to about 90 degrees by set screw 52 which projects through slot 54. Set screw 52 is held in place on axle shaft 44 by clamp collar 50. The set screw in the slot stops rotation with the oar blades 22 in the vertical position for the power stroke or in the horizontal position for the return stroke. The set screw can be loosened and the clamp collar rotated to adjust the pitch of the oar blades.

The connection joint and lifting mechanism is best shown in FIG. 2 and FIG. 3. Vertical shaft 60 slides up and down in guide 62 allowing block 58 to move up and down. Vertical shaft 60 also rotates in guide 62 allowing block 58 to rotate in a horizontal plane. Clevis 46 is rotatably attached to block 58 with pins 56 allowing the clevis to swing up and down in a vertical plane. Clevis 46 also moves up and down and rotates with block 58. Fulcrum 74 is rotatably attached to clevis 46 with pins 76 allowing the bottom portion of the fulcrum to remain flat against bearing surface 72. The fulcrum slides on the bearing surface as the clevis is swung forward and aft and up and down. Downward force from compression spring 66 is applied to bushing 68*b* and transmitted to nut 70 and to vertical shaft 60. This downward force on the inboard end of clevis 46, acting on fulcrum 74, causes lift on the outboard end of clevis 46, which is transmitted to the oar shaft 18. The spring is sized to provide enough force to lift the oar and the force is adjustable by nut 70. Shim 78 limits the uplifting action and can be varied by changing the shim size so that, for example, the oars will just clear the water when block 58 contacts the shim. The oars can be lifted beyond this point, but the lift will not be spring assisted.

CONCLUSION, RAMIFICATIONS, AND SCOPE OF INVENTION

Thus the reader will see that the rowing apparatus of the invention provides a rowing system which is safer, easier to use, more maneuverable and has less wind resistance than previously known systems.

While my above description contains many specifications, these should not be construed as limitations on the scope of the invention, but rather as an exemplification of one preferred embodiment thereof. Many other variations are possible. For example:

(a) more than one unit could be used on the same hull;

(b) the base could be made integral with the hull;

(c) the seat could be fixed rather than sliding or no seat at all and the apparatus operated in the kneeling or standing position.

(d) the springs could be located above the block, the vertical shaft could be made stationary and the rotary and up and down motion could be made at blocks 58;

(e) shims could be added between bushings 68*a* and 68*b* to limit the depth of the oars on the power stroke;

(f) axle motion for feathering could be incorporated into the clevis rather than the feathering sleeve;

Accordingly, the scope of the invention should be determined not by the embodiment illustrated, but by the appended claims and their legal equivalents.

I claim:

1. A means for propelling a boat comprising, in combination:

(a) an oar;

(b) a support;

(c) a means of connecting said oar to said support, permitting movement of said oar pivotally in a substantially horizontal plane; pivotally in a substantially vertical plane and linearly substantially upward and downward;

(d) a fulcrum means located between the vertical pivot axis and the outboard end of said oar;

(e) a substantially horizontal bearing surface which supports said fulcrum means;

(f) a means of applying substantially downward force inboard of said fulcrum, causing lift on the outboard end of said oar.

2. The means for propelling a boat of claim 1 wherein the oar connecting means includes:

(a) a shaft, (b) a means of guiding and supporting said shaft in a substantially vertical position and permitting movement of said shaft both linearly and rotationally, (c) a clevis, rotatably connected to said shaft, permitting movement rotationally in a vertical plane, (d) a means of retaining said shaft in said supporting means, (e) a means of connecting an oar to said clevis.

3. The means for propelling a boat of claim 1 wherein the fulcrum means is a channel shaped member rotatably connected to the oar connecting means.

4. The means for propelling a boat of claim 1 wherein the means of applying substantially downward force is a compression spring in tension between the support and the means of connecting the oar to said support.

5. The means for propelling a boat of claim 1 wherein the substantially horizontal bearing surface is a sheet of low friction plastic.

6. An oar comprising:

(a) a blade;

(b) an outboard shaft;

(c) a handle;

(d) an inboard shaft;

(e) a means of connection said inboard shaft to a support; wherein said outboard shaft and said inboard shaft are arranged to have their centerlines coaxial, and having said handle arranged between said outboard shaft and said inboard shaft and inclined away from said outboard shaft such that the centerline of said handle is offset from the centerline of said outboard shaft and forms an angle of approximately 30 degrees with the centerline of said outboard shaft, and having said blade at the outboard most end of said outboard shaft; whereby the torsion caused by said handle being off-center tends to rotate said oar in the correct direction for power stroke or feathering stroke.

* * * * *